US007703769B2

(12) United States Patent
Schwarzbauer

(10) Patent No.: US 7,703,769 B2
(45) Date of Patent: Apr. 27, 2010

(54) DEVICE FOR SEPARATING OVERLAPPING, FLAT ITEMS OF MAIL

(75) Inventor: Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/886,090

(22) PCT Filed: Jan. 27, 2006

(86) PCT No.: PCT/EP2006/000733

§ 371 (c)(1),
(2), (4) Date: Apr. 2, 2008

(87) PCT Pub. No.: WO2006/097161

PCT Pub. Date: Sep. 21, 2006

(65) Prior Publication Data

US 2008/0237971 A1 Oct. 2, 2008

(30) Foreign Application Priority Data

Mar. 16, 2005 (DE) ..... 10 2005 012 029

(51) Int. Cl.
*B65H 5/02* (2006.01)

(52) U.S. Cl. ..... 271/275

(58) Field of Classification Search ..... 271/2, 271/34, 275, 272, 3.21, 6, 4.06, 10.06, 10.07, 271/10.1, 10.15, 202, 198, 121, 122; 198/453–455, 198/459.1

See application file for complete search history.

(56) References Cited

U.S. PATENT DOCUMENTS

| | | | | | |
|---|---|---|---|---|---|
| 2,819,077 | A | * | 1/1958 | Goss | 271/35 |
| 3,773,317 | A | * | 11/1973 | Kummerer | 271/34 |
| 4,046,369 | A | * | 9/1977 | Kluge et al. | 271/3.05 |
| 4,074,902 | A | * | 2/1978 | Bradbury | 271/34 |
| 4,114,870 | A | * | 9/1978 | Di Blasio | 271/35 |
| 4,534,550 | A | * | 8/1985 | Reist | 271/183 |
| 4,544,147 | A | * | 10/1985 | Dinnissen | 271/35 |
| 4,772,004 | A | * | 9/1988 | Golicz | 271/124 |
| 4,905,981 | A | * | 3/1990 | Reist | 271/233 |
| 4,909,499 | A | * | 3/1990 | O'Brien et al. | 271/10.06 |
| 4,934,685 | A | * | 6/1990 | Shifley | 271/35 |
| 4,978,114 | A | * | 12/1990 | Holbrook | 271/35 |

(Continued)

FOREIGN PATENT DOCUMENTS

JP 10139184 A 5/1998

*Primary Examiner*—Patrick H Mackey
*Assistant Examiner*—Jeremy Severson
(74) *Attorney, Agent, or Firm*—Laurence A. Greenberg; Werner H. Stemer; Ralph E. Locher

(57) ABSTRACT

A device for separating overlapping, flat items of mail in an upright position in a transport path has separating sections arranged in the transport path and having transport belts. A stationary retaining strip running over a length of all separating sections is attached on the transport path on a side opposite the transport belt and operates on the mail items with friction force. Pressure elements for pressing the retaining strip onto transported mail items are distributed over a length of the retaining strip. Each pressure element comprises a coupling lever, pressure rollers and an elastic belt loop. The belt loop is attached a back of the retaining strip, and guided via the pressure rollers on ends of the coupling lever running in longitudinal direction of the retaining strip. The coupling lever is displaceably supported on a pivot axis.

7 Claims, 3 Drawing Sheets

U.S. PATENT DOCUMENTS 5,072,921 A 12/1991 Golicz
5,074,540 A * 12/1991 Belec et al. ..... 271/34
5,238,236 A * 8/1993 Belec et al. ..... 271/34
5,244,197 A * 9/1993 Helmstadter ..... 271/35
5,244,198 A * 9/1993 Green ..... 271/125
5,257,777 A * 11/1993 Kalika et al. ..... 271/35
5,542,349 A * 8/1996 Gosslinghoff ..... 100/161
5,601,282 A * 2/1997 Milo et al. ..... 271/35
5,735,518 A * 4/1998 Takemoto et al. ..... 271/274
6,003,857 A * 12/1999 Salomon et al. ..... 271/122
6,135,441 A * 10/2000 Belec et al. ..... 271/35
6,276,679 B1 * 8/2001 Joyce et al. ..... 271/122
6,302,260 B1 * 10/2001 Hansch ..... 198/418.8
6,409,168 B1 * 6/2002 Leu ..... 271/270
6,435,498 B1 * 8/2002 Stefan et al. ..... 271/2
6,485,012 B1 * 11/2002 Bakoledis ..... 271/35
6,585,251 B2 * 7/2003 Allen et al. ..... 271/121
6,932,338 B1 * 8/2005 Popejoy et al. ..... 271/122
6,938,894 B2 * 9/2005 Miller et al. ..... 271/274
6,942,216 B1 * 9/2005 Koelle ..... 271/270
6,971,645 B2 * 12/2005 Coret et al. ..... 271/138
7,040,616 B2 * 5/2006 Stemmle ..... 271/270
7,131,645 B2 * 11/2006 Bodereau ..... 271/270
7,168,696 B2 * 1/2007 Zattler ..... 271/10.07
7,168,700 B2 * 1/2007 Skadow et al. ..... 271/270
7,192,025 B1 * 3/2007 Golicz et al. ..... 271/34
7,344,016 B2 * 3/2008 Vogel et al. ..... 198/412
2002/0140156 A1 * 10/2002 Wilson et al. ..... 271/10.07
2003/0234158 A1 * 12/2003 Zattler ..... 198/454
2005/0285332 A1 * 12/2005 Bodereau ..... 271/202
2006/0220294 A1 * 10/2006 Sye ..... 271/2
2007/0085259 A1 * 4/2007 Grogor et al. ..... 271/34
2007/0252321 A1 * 11/2007 Kutzer et al. ..... 271/34
2009/0091073 A1 * 4/2009 Joyce et al. ..... 271/4.02

* cited by examiner

DEVICE FOR SEPARATING OVERLAPPING, FLAT ITEMS OF MAIL

CROSS-REFERENCE TO RELATED APPLICATIONS

The present application is a national phase application of PCT/EP2006/000733, filed Jan. 27, 2006, which claims priority to German application no. 10 2005 012 029.6, filed Mar. 16, 2005, which are hereby incorporated by reference.

BACKGROUND OF THE INVENTION

The invention relates to a device for separating overlapping, flat items of mail.

A separation device with a number of separating sections one behind the other for separating flat items of mail in an upright position is described in DE 103 50 352 B3 which has a fixed-position retaining strip over its entire length with retaining elements in the form of strips which are spaced in relation to each other, in relation to the extraction belts and are offset in height in relation to the extraction belts. In order to create the necessary pressure by the retaining elements of the retaining strip on the mail items, pressure elements are provided over the length of the strip which press with spring force from behind directly against the retaining strip. The pressure elements have pressure rollers at their ends with flanged wheels for keeping the retaining strip up. During the passage of a bulky item the retaining strip can be impermissibly displaced onto the pressure elements so that the retaining strip can be damaged. This then results in malfunctions and double extractions. If such a fault is caused by a number of mail items jamming, then the pressure on the mail items must be relieved and the operator then removes the jammed mail items. To this end the transport path must be opened by moving the retaining strip backwards out of its operating position. In such cases the danger arises of the retaining strip coming away from the pressure elements and thus no longer being guided in its position.

A separation device (U.S. Pat. No. 5,257,777 A) with retaining strip in a fixed location was also known, featuring strip-shaped retaining elements in which the necessary retaining pressure is generated by the belt tension. A separation device is described in DE 102 12 024 A1 which features a circulating belt for separating a number of contiguous goods items, where the direction of conveyance on the conveying channel is opposite to the direction of conveyance of the extraction belt. A number of elastically supported pressure roller devices are provided for guiding and supporting the separation belt.

SUMMARY OF THE INVENTION

The underlying object of the invention is thus to create a device for separating overlapping, flat items of mail with a fixed-position retaining strip and pressure elements which allow displacements of the retaining strip in the longitudinal direction towards the pressure elements for thick or bulky postal items and which, even when the transport path is opened, safely guarantees the guidance of the retaining strip on the pressure elements.

Accordingly, one aspect involves a device for separating overlapping, flat items of mail in an upright position in a transport path. The device includes a number of separating sections arranged in the transport path and having transport belts, a stationary retaining strip running over a length of all separating sections is attached on the transport path on a side opposite the transport belt and operates on the mail items with friction force, and pressure elements for pressing the retaining strip onto transported mail items, distributed over a length of the retaining strip. Each pressure element has a coupling lever, rotationally-mounted pressure rollers and an elastic belt loop. The belt loop is attached to the retaining strip in each case to a back of the retaining strip by an approximately point-type connection in longitudinal direction of the belt. The belt loop is guided via the rotationally-mounted pressure rollers on ends of the coupling lever running in longitudinal direction of the retaining strip. The coupling lever is displaceably supported on a pivot axis running perpendicular to the longitudinal direction of the retaining strip and parallel to the retaining strip.

In this case there are elastic belt loops on the rear side of the retaining strip which are each guided by pressure rollers which are rotationally mounted in each case on the ends of a coupling lever which extends in the longitudinal direction of the retaining strip, with each belt secured by a roughly point-shaped connection in the longitudinal direction of the belt. The coupling lever is displaceably mounted on a pivotable axis of the respective pressure elements which extends in a perpendicular manner in relation to the longitudinal direction of the retaining strip and parallel to the retaining strip. This specific positive-fit connection between the retaining strip and the pressure elements allows stress-free displacements of the retaining strip in the transport path direction and guarantees the guidance of the retaining strip even when the transport path is opened.

Advantageous embodiments of the invention are set down in the subclaims.

To ensure that the retaining strip is guided in a defined manner, the belt loops are advantageously guided over the pressure rollers under pre-tension.

It is advantageous as regards minimizing outlay and ensuring functional security for the pressure element to include a pressure lever pivotably supported on an axis of rotation, on one end of which the pivot axis is located and on the other end of which a spring element engages and presses the end with the pivot axis in the direction of the retaining strip.

So that the pressure of a relatively wide retaining strip can be guaranteed over the entire width, it is advantageous, on the respective axis of rotation, for a further pressure lever operating under spring force with coupling lever and pressure rollers to be displaceably arranged.

To improve the rear strip effect it is advantageous for two narrow strip-shaped and raised contact surfaces, one with the width of the belt loops as its height and the other at the height of the other pressure rollers of this axis of rotation to be located in the longitudinal direction of the retaining strip.

It is also advantageous, if for secure guidance of the retaining strip the pressure rollers have the edge disks guiding the belt loops on their outside, with the edge disks running in slots in the retaining strip.

It is further advantageous to arrange the contact surfaces on the retaining strip and to arrange the transport belts offset in height to each other. This means that it is possible for the transport belts and the contact surfaces of the retaining strip to operate even on very thin postal items, but for the contact surfaces and the transport belts not to rub against each other with larger gaps between mail items.

BRIEF DESCRIPTION OF THE SEVERAL VIEWS OF THE DRAWINGS

The invention is explained below in an exemplary embodiment with reference to the drawing.

The figures show

DETAILED DESCRIPTION OF THE INVENTION

Figure 1:
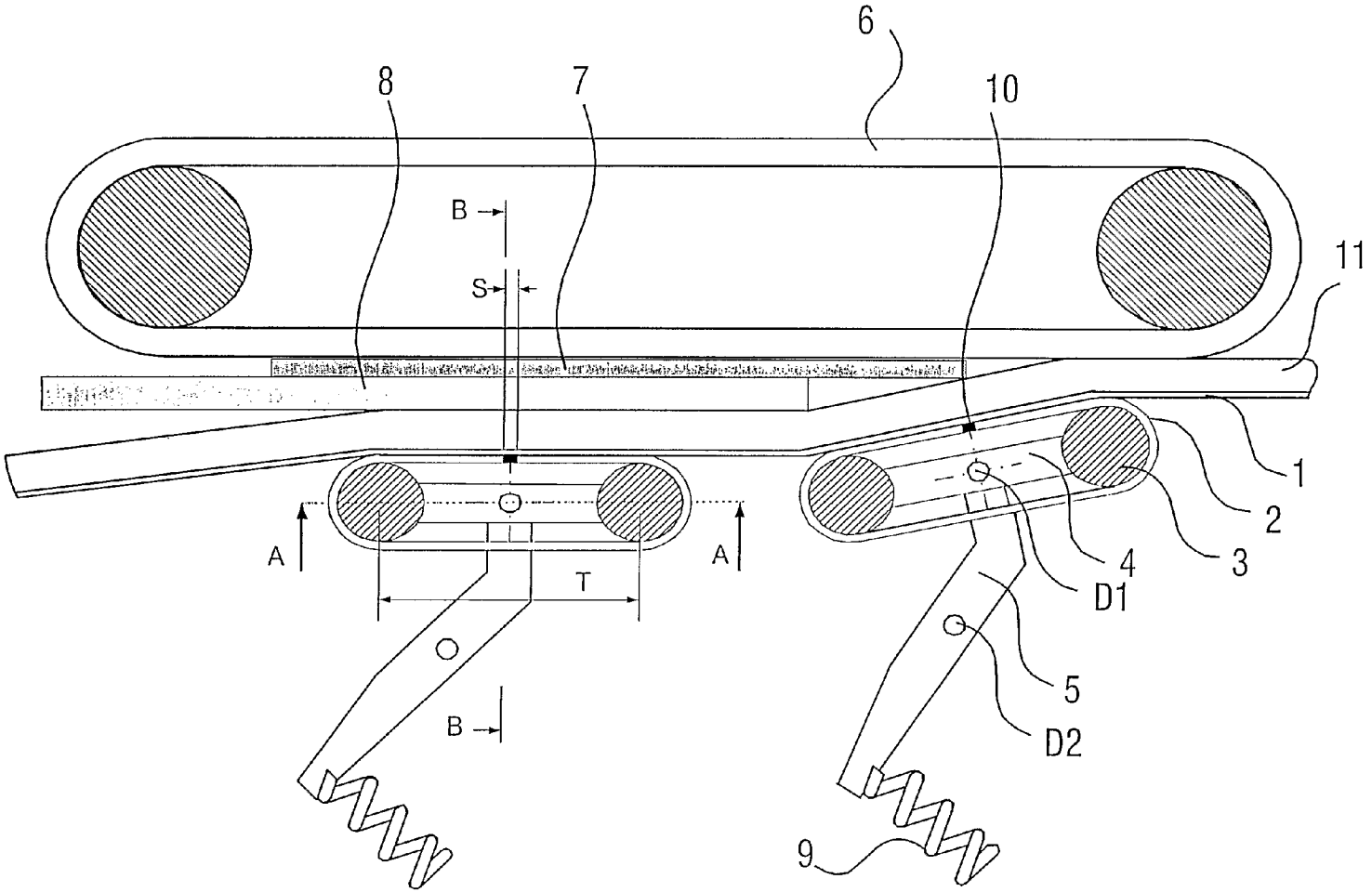
FIG. 1 a schematic overhead view of a separation stage with two pressure elements, FIG. 2 a view of section A-A from FIG. 1
Figure 2:
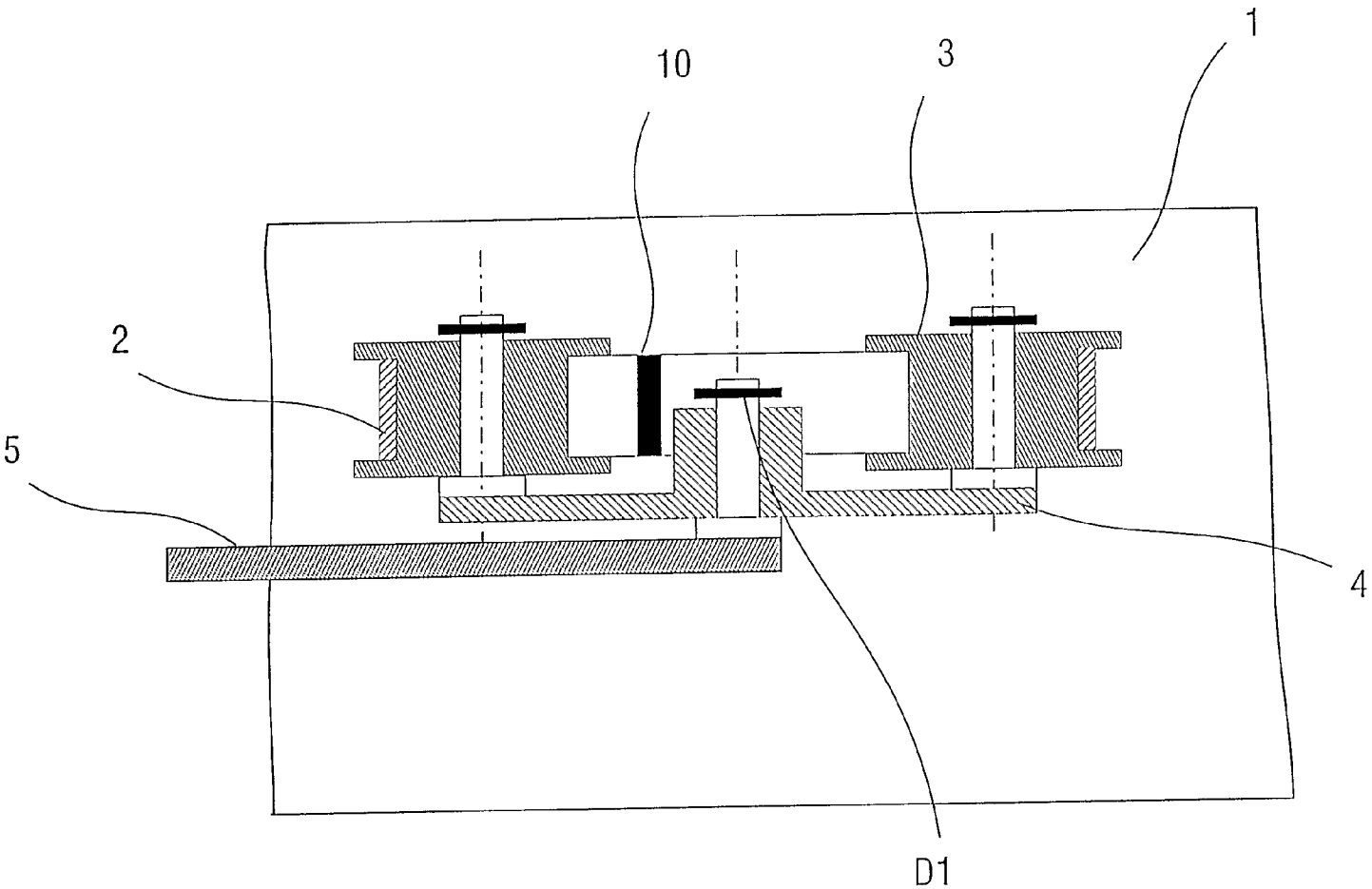
Figure 3:
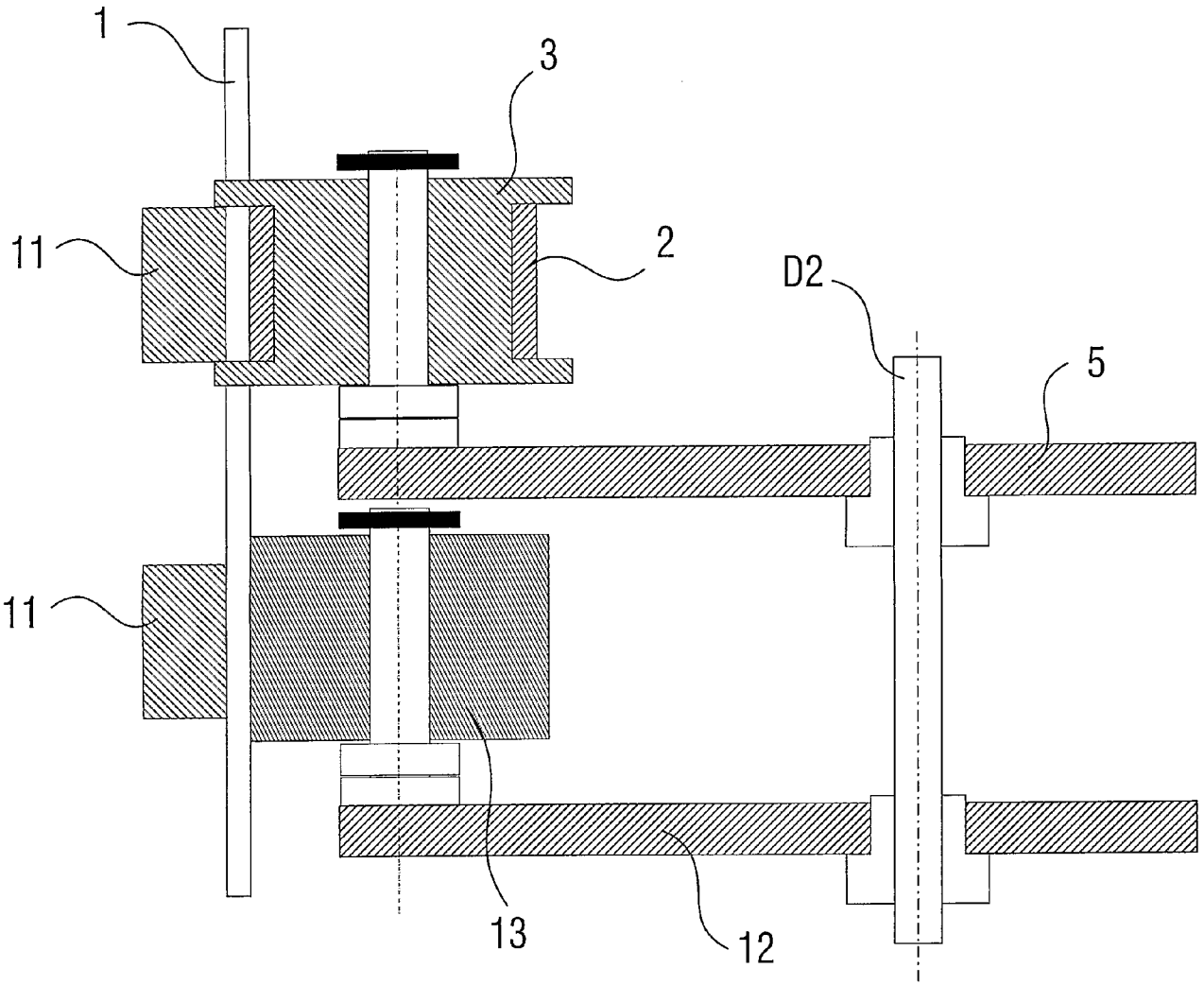
FIG. 3 a view of section B-B from FIG. 1

At each transport stage a number of driven, circulating transport belts 6 are located on the transport path opposite each other for transporting and accelerating the mail items 7, 8 by means of friction force. On the other side is arranged a stationary retaining strip 1 which features over the length of the strip two narrow strip-shaped, raised contact surfaces 11. The transport belts 6 and the contact surfaces 11 are offset in height from each other, so that in the rest position they can overlap in the direction of the vector on the mail item wide side, without the friction surfaces touching each other in the absence of mail items 7, 8 in the transport path and thereby quickly wearing out. This enables the necessary pressure to be created even for thin postal items 7, 8. The pressure exerted on the mail items by the retaining strip 1 is created by a pressure lever 5 supported in each case at a pivot point D2 on which a pressure spring 9 engages at the ends facing away from the retaining strip 1 in each case. Attached to the rear of the retaining strip 1 are elastic belt loops 2 each with a narrow weld seam 10 running vertically in the longitudinal direction of the retaining strip 1 (two for each separation stage). Each belt loop 2 is guided via two pressure rollers 3 provided with flanged wheels, which are rotationally mounted at the ends of a coupling lever 4 under pre-tension. In this case the flanged wheels run in slots of the retaining strip 1. On the other side of the retaining strip 1 between the slots is located the upper raised contact surface 11, which also prevents the flanged wheels from having a negative effect on each other. The coupling lever 4 in its turn is displaceably supported via a rotation support D1 approximately in the center on the free end of the pressure lever 5. The pressure lever 5 in this case is pressed by the pressure spring 9 in the direction of retaining strip 1. During transport of the mail items 7, 8 through the transport path the retaining strip 1 is deflected away from the transport belt 5 in accordance with the gaps between mail items. In this case the pressure levers 5 are also coupled to the retaining strip 1 by a positive fit and each longitudinal deflection of the retaining strip 1 in relation to the pressure levers 5 occurring during the passage of the mail items 7, 8 is compensated for via the belt loops 2. The maximum allowed longitudinal displacement amounts to $\pm L-S/2$ (L=length of the coupling lever, S=width of the weld seam). Since the retaining strip 1 is relatively wide, to ensure the necessary pressure over the full width of the retaining strip, a second rotationally supported coupling lever 12, on which a pressure spring also engages is located on the axis of rotation of each rotational support D2 below the described coupling lever 5. Further pressure rollers 13 are rotationally attached at the end of this coupling lever 12 over which no belt loops run however.

The invention claimed is:

1. A device for separating overlapping, flat items of mail in an upright position in a transport path, comprising a plurality of separating sections that are arranged in the transport path and have transport belts;

a stationary retaining strip running over a length of all separating sections that is attached on the transport path on a side opposite the transport belts and that operates on the mail items with friction force; and pressure elements for pressing the retaining strip onto transported mail items that are distributed over a length of the retaining strip, wherein each pressure element comprises a coupling lever, rotationally-mounted pressure rollers and an elastic belt loop, wherein the belt loop is attached to the retaining strip in each case to a back of the retaining strip by an approximately point-type connection in longitudinal direction of the belt, wherein the belt loop is guided via the rotationally-mounted pressure rollers on ends of the coupling lever running in longitudinal direction of the retaining strip, and wherein the coupling lever is displaceably supported on a pivot axis running perpendicular to the longitudinal direction of the retaining strip and parallel to the retaining strip.

2. The device of claim 1, wherein the belt loops are guided under pre-tension over the pressure rollers.

3. The device of claim 1, wherein the pressure element includes a pressure lever supported rotationally on an axis of rotation, on one end of which the pivot axis is located and on the other end of which a spring element engages and presses the end with the pivot axis in the direction of the retaining strip.

4. The device of claim 3, wherein on the respective axis of rotation a further pressure lever operating under spring force with a further coupling lever and further pressure rollers is displaceably arranged.

5. The device of claim 4, wherein at least two narrow stripform and raised contact surfaces are located on a front and in the longitudinal direction of the retaining strip, with one of the contact surfaces having a width of the belt loops and being located at a height of the belt loops, and the other of the contact surfaces being arranged at a height of the further pressure rollers.

6. The device of claim 5, wherein the pressure rollers have flanged wheels guiding the belt loops on an outside, with the flanged wheels running in slots in the retaining strip.

7. The device of claim 5, wherein the contact surfaces are arranged on the retaining strip and the transport belts are arranged offset in height from each other.

* * * * *